US005884714A

United States Patent [19]

Heller et al.

[11] Patent Number: 5,884,714

[45] **Date of Patent: *Mar. 23, 1999**

[54] METHOD AND APPARATUS FOR FLUID AND SOIL SAMPLING

[75] Inventors: Noah Heller, Mill Valley; Jeffrey Barrow, Woodland, both of Calif.; Joe DeMartini, Glen Allen, Va.

[73] Assignee: SimulProbe Technologies, Inc., Novato, Calif.

[ * ] Notice: The term of this patent shall not extend beyond the expiration date of Pat. No. 5,421,419.

[21] Appl. No.: 449,256

[22] Filed: May 24, 1995

Related U.S. Application Data

[63] Continuation of Ser. No. 124,789, Sep. 21, 1993, Pat. No. 5,421,419.

[51] Int. Cl.[6] ..... E21B 49/02; E21B 49/08

[52] U.S. Cl. ..... 175/20; 175/58; 175/59; 175/403

[58] Field of Search ..... 175/58, 59, 20, 175/244, 249, 320, 403, 405

[56] References Cited

U.S. PATENT DOCUMENTS

| | | | |
|---|---|---|---|
| 763,212 | 6/1904 | Shuman | 175/23 |
| 1,737,256 | 11/1929 | McQuiston | 175/58 |
| 1,896,703 | 2/1933 | Dean | 175/249 |
| 2,167,991 | 8/1939 | Oliver | 175/404 |
| 2,283,650 | 5/1942 | Sanborn | 255/1.4 |
| 2,313,576 | 3/1943 | Phillips et al. | 175/249 |
| 2,382,992 | 8/1945 | Harris | 255/1.4 |
| 2,664,269 | 12/1953 | Knight et al. | 255/1 |
| 2,751,010 | 6/1956 | Trahan | 175/249 |
| 3,016,096 | 1/1962 | Spalding | 166/332 |
| 3,047,081 | 7/1962 | Pitcher | 175/239 |
| 3,064,742 | 11/1962 | H. Bridwell | 175/59 |
| 3,151,681 | 10/1964 | Cochran | 166/332 |
| 3,318,394 | 5/1967 | Gleason et al. | 175/5 |
| 3,367,188 | 2/1968 | R. Robinson | 175/20 |
| 3,412,814 | 11/1968 | Rosfelder | 175/6 |
| 3,447,615 | 6/1969 | Schick | 175/17 |
| 3,685,345 | 8/1972 | Wise | 73/19 |
| 3,794,127 | 2/1974 | Davis | 175/58 |
| 3,805,900 | 4/1974 | Sainsbury | 175/249 |
| 4,098,360 | 7/1978 | Clements | 175/313 |
| 4,317,490 | 3/1982 | Milberger et al. | 175/20 |
| 4,335,622 | 6/1982 | Bartz | 73/864.74 |
| 4,452,091 | 6/1984 | Richers | 73/864.52 |
| 4,518,050 | 5/1985 | Sollie et al. | 175/250 |
| 4,518,051 | 5/1985 | Sollie et al. | 175/250 |
| 4,588,036 | 5/1986 | Desrochers et al. | 175/58 |
| 4,669,554 | 6/1987 | Cordry | 175/59 |
| 4,729,437 | 3/1988 | Zapico | 175/20 |
| 4,809,790 | 3/1989 | Manchak, Jr. | 175/17 |
| 4,928,541 | 5/1990 | Toon et al. | 73/864.63 |
| 4,953,637 | 9/1990 | Starr et al. | 175/20 |
| 5,046,568 | 9/1991 | Cordry | 175/21 |
| 5,146,998 | 9/1992 | Cordry et al. | 175/21 |
| 5,186,263 | 2/1993 | Kejr et al. | 175/20 |
| 5,211,249 | 5/1993 | Ritcher et al. | 175/20 |

FOREIGN PATENT DOCUMENTS

| | | | |
|---|---|---|---|
| 896253 | 2/1945 | France | 175/58 |
| 713982 | 2/1980 | Russian Federation | 175/244 |
| 1177444 | 9/1985 | Russian Federation | 175/59 |

OTHER PUBLICATIONS

Gillham, et al. *"A Device for In Situ Determination of Geochemical Transport Parameters 1. Retardation"*; Ground Water; vol. 28, No. 5; Sep.–Oct. 1990; pp. 858–862.

Gillham, et al. *"A Device for In Situ Determination of Geochemical Transport Parameter 2. Biochemical Reactions"* Ground Water; vol. 28, No. 6; Nov.–Dec. 1990; pp. 858–862.

*Primary Examiner*—Hoang C. Dang
*Attorney, Agent, or Firm*—Limbach & Limbach L.L.P.

[57] ABSTRACT

A sampling device includes a barrel having a downhole end, an exterior surface, an interior surface defining a hollow interior, and an open end at the downhole end of the hollow interior. A fluid entrance penetrates the exterior surface. A fluid path having an outlet port is fluidly coupled to the fluid entrance. The device is driven into a subsurface so that a soil sample is forced into the hollow interior. While the device is still in the subsurface a fluid sample is collected through the least one fluid entrance and fluid path.

17 Claims, 10 Drawing Sheets

METHOD AND APPARATUS FOR FLUID AND SOIL SAMPLING

This application is a continuation of Ser. No. 08/124,789 filed on Sep. 21, 1993, now U.S. Pat. No. 5,421,419.

BACKGROUND OF THE INVENTION

The present invention relates to the field of fluid and soil sampling methods and apparatus. Modern industries produce contaminants which have been released onto land. The contaminants migrate downward into the subsurface creating potential health risks. Contaminant remediation plans are implemented to remove soil and ground water contamination.

Designing a remediation plan typically requires collecting soil and fluid samples to determine the extent of subsurface contamination. The term fluid as used herein refers to both gas and liquid. Soil samples provide subsurface data including contaminant concentration for inorganic and organic compounds, grain size, mineral composition, texture, density, permeability and porosity. Fluid samples are analyzed to determine contaminant concentration, organic chemistry in the case of soil gas, and both organic and inorganic chemistry in the case of liquid.

A conventional method of collecting soil and soil gas samples is to drill a borehole to a desired sampling depth and lower a soil sampling device into the bottom of the borehole. Soil sampling devices typically have a hollow interior and are driven into the formation by repetitive percussion. As the device is driven into the formation a soil sample is forced into the hollow interior. The sampling device is removed from the borehole to retrieve the soil sample. A soil gas probe is then lowered into the borehole and driven into the formation to collect a gas sample.

A problem with the conventional method of collecting soil and soil gas samples is that during the time between retrieval of the soil sampling device and lowering of the soil gas probe, the gas in the subsurface immediately below the bottom of the borehole may be released into the borehole atmosphere before it can be collected by the soil gas probe. off-gassing results from decreased lithostatic load due to removal of soil in the borehole. The off-gassing into the borehole will likely reduce the soil gas concentration readings.

A further problem with the known method is that the soil and soil gas samples are not collected from the same depth. When constructing a contaminant distribution model it is highly desirable to have both soil and fluid samples from the same depth for direct correlation between various soil and fluid data.

A second conventional method for extracting soil and gas samples from the same depth is to first drive the soil gas probe into the bottom of the borehole and collect a soil gas sample. The soil gas probe is then removed from the borehole and a soil sampling device is lowered into the borehole. The soil sampling device is driven around the hole produced by the soil gas probe. The soil sampler is then removed from the borehole to recover the sample. The soil sample will include a cylindrical depression formed by the soil gas probe.

A problem with the second conventional method of collecting soil and soil gas samples from the same depth is that the soil sample is manifestly disturbed by the collapsed hole made by the gas probe. The collapsed hole adversely affects various measurements, such as permeability, porosity and texture. The soil sample may also be chemically biased by off-gassing during soil gas sample collection. Off-gassing may affect, for example, the amount of volatile organics in the soil sample.

Conventional fluid and soil sampling devices collect either soil or fluid samples. Before each device is lowered into the borehole the device is decontaminated so that the sampling is not tainted. A problem with conventional fluid and soil sampling devices is that each device must be decontaminated, lowered into the borehole, and removed from the borehole to collect each individual sample. The increased operating time necessary to extract both soil and fluid samples increases the cost of extracting the samples.

SUMMARY OF THE INVENTION

The problems associated with prior art fluid and soil sampling methods and apparatus are overcome in accordance with the method and apparatus of the present invention. An environmental sampling device includes a barrel having a downhole end, an exterior surface, an interior surface defining a hollow interior, and an open end at the downhole end of the hollow interior. A fluid entrance penetrates the exterior surface and a fluid path is fluidly coupled to the fluid entrance and positioned between the interior and exterior surfaces.

The downhole end of the sampling device is driven into a subsurface so that a soil sample of the subsurface is forced through the open end and into the hollow interior. While the sampling device is in the subsurface a fluid sample is collected from the subsurface through the fluid entrance and the fluid path.

The sampling device preferably includes a mechanism for preventing a fluid flow through the fluid entrance until after the driving step has been initiated. A preferred fluid flow preventing mechanism is a drive shoe which is movably mounted to the barrel between a first position, in which the drive shoe covers the fluid entrance, and a second position, in which the drive shoe is spaced apart from the fluid entrance. The drive shoe is moved to the second position by pulling the sampling device toward an uphole end before the collecting step. As the sampling device is pulled toward the uphole end the drive shoe frictionally engages the formation and moves to the second position. The fluid flow preventing mechanism may also be an elastic band sized to fit around the barrel and positioned to cover the fluid entrance.

The hollow interior preferably has a substantially cylindrical shape and an inner diameter in a range of about 1 to 6 inches. The fluid path preferably includes an annular channel housed between the interior and exterior surfaces and fluidly coupled to the fluid entrance.

The barrel preferably includes a drive shoe rigidly attached to the downhole end of the barrel. The drive shoe has an angular cutting edge defining the open end. The drive shoe defines a portion of the exterior surface of the barrel. The fluid entrance preferably penetrates the portion of the exterior surface at the drive shoe.

The sampling device also preferably includes a valve assembly rigidly attached to the barrel at an uphole end. The valve assembly houses a displaced air line having an exhaust port and an entrance port. The displaced air line provides an exhaust path for air displaced in the hollow interior by the soil sample. A check valve is positioned along the displaced air line between the entrance port and the exhaust port which permits flow only from the entrance port to the exhaust port.

Other features and advantages of the invention will appear from the following description in which the preferred embodiments have been set forth in detail in conjunction with the accompanying drawings.

DESCRIPTION OF THE PREFERRED EMBODIMENT

Figure 1:
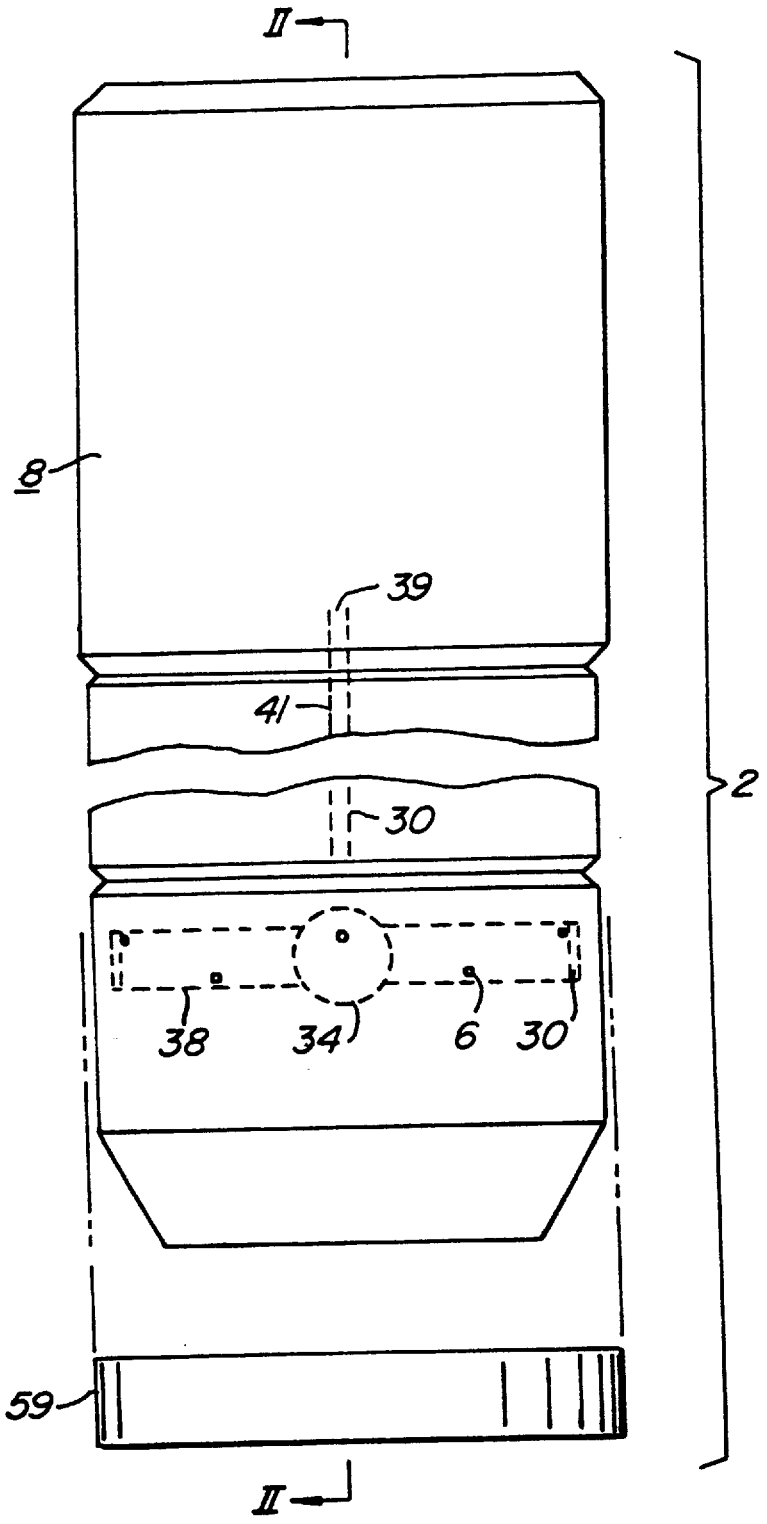
FIG. 1 is a side view of a soil and fluid sampling device.
Figure 2:
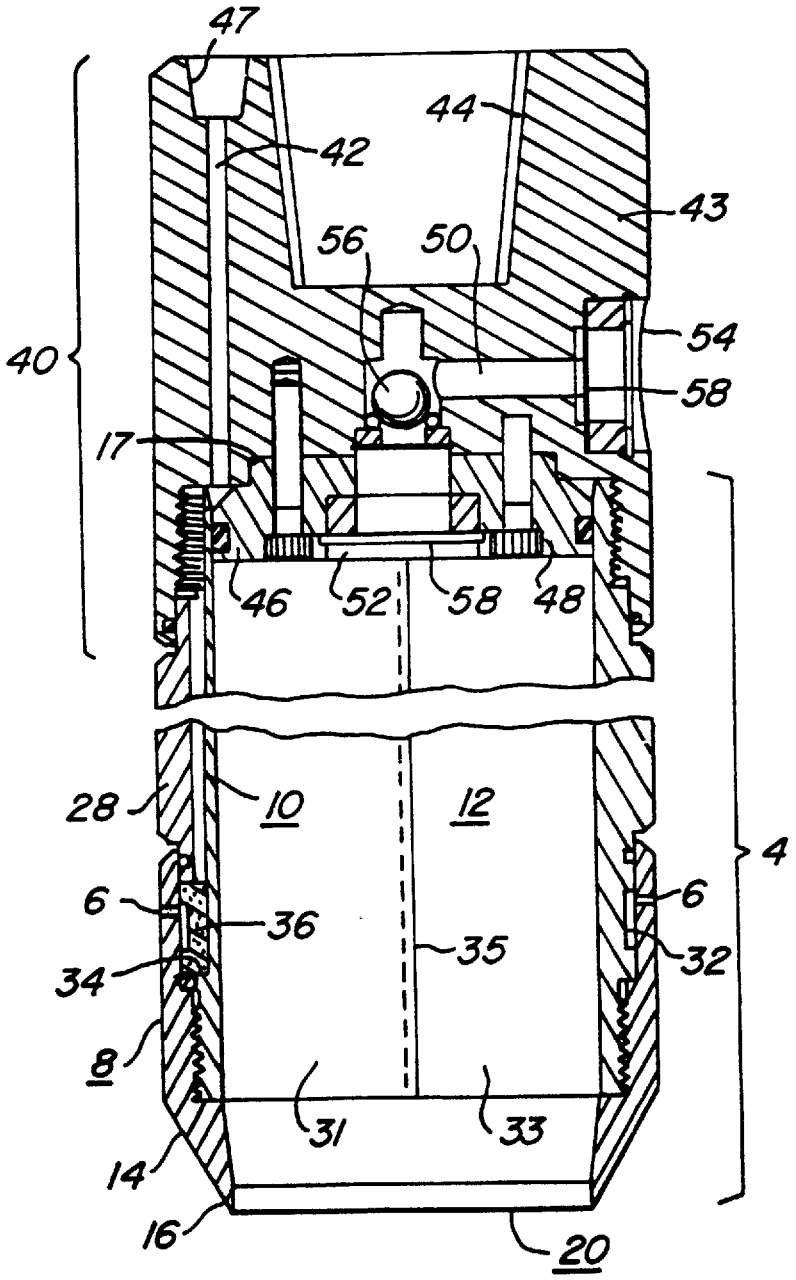
FIG. 2 is a cross-sectional view of the sampling device of FIG. 1 along line II—II.

A sampling device 2 for collecting a soil and a fluid sample includes a barrel 4 having an exterior surface 8 and an interior surface 10 (FIGS. 1 and 2). The exterior and interior surfaces 8, 10 may take any shape but are preferably generally cylindrical. A fluid entrance 6 penetrates the exterior surface 8 and is used to collect a fluid sample as described below.

The interior surface 10 of the barrel 4 defines a hollow interior 12. A soil sample is collected by driving the sampling device 2 into a subsurface so that the soil sample is forced into the hollow interior 12 of the barrel 4. The sampling device 2 is preferably driven into the subsurface by a wire line driven drive hammer or rod driven drive hammer (not shown). The sampling device 2 may also be driven into the formation by any other conventional method, such as rotary drilling.

Figure 5:
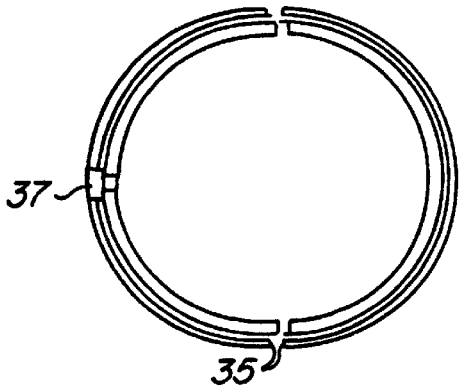
FIG. 5 is cross-sectional view of the sample tube of FIG. 3 along line V—V.
Figure 6:
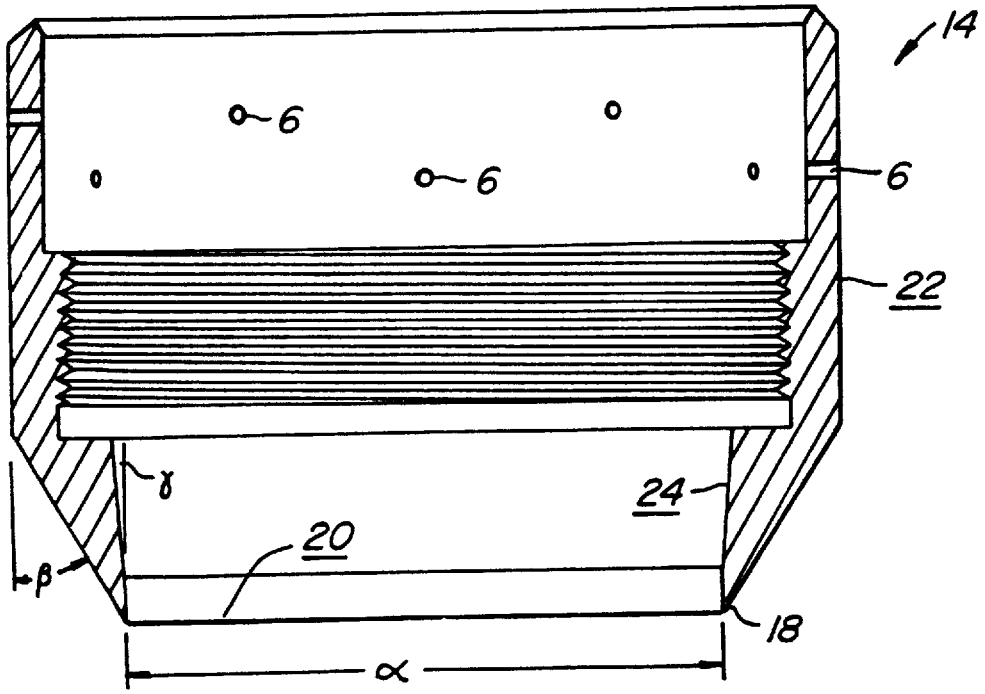
FIG. 6 is a cross-sectional view of a drive shoe.

The barrel 4 includes a sample tube 28 and a drive shoe 14 (FIG. 6) connected to the sample tube at a downhole end 16. The drive shoe 14 and sample tube 28 are preferably formed separately but may also be formed in one piece. The sample tube 28 is preferably split longitudinally along a split line 35 into first and second sections 31, 33 (FIGS. 5 and 6). The inner diameter of the sample tube is preferably in a range from about ½ to 6 inches, most preferably in a range of 1 to 4 inches and most preferably about 2½ inches when the hollow interior has a circular cross-section. If the hollow interior has any other cross-sectional shape, the area of the cross-sectional shape is preferably in a range of 0.79 to 113.10 square inches and most preferably in a range of 3.14 to 50.27 square inches. The first and second sections 31, 33 are secured together at the downhole end by the drive shoe 14 and at an uphole end 17 by a valve assembly 40. The valve assembly 40 includes an outer body 43 and an inner body 46 attached to the outer body 43 with bolts 48.

The drive shoe 14 has an angular cutting edge 18 for piercing the subsurface (FIG. 6). The angular cutting edge 18 defines an open end 20 leading to the hollow interior 12. The open end 20 preferably has a diameter $\alpha$ of about 2.375 inches but may range from about 1 inch to about 4 inches. The angular cutting edge 18 has an angle $\beta$ oriented about 30° from the outer surface 22 of the drive shoe (FIG. 6). An inner surface 24 of the drive shoe is oriented at an angle $\gamma$ which is about 3° with respect to a vertical axis 26 of the drive shoe. The drive shoe is preferably made of heat treated SAE 4140 steel. The preceding dimensions are preferred, however, any other drive shoe configuration may also be used.

Figure 8:
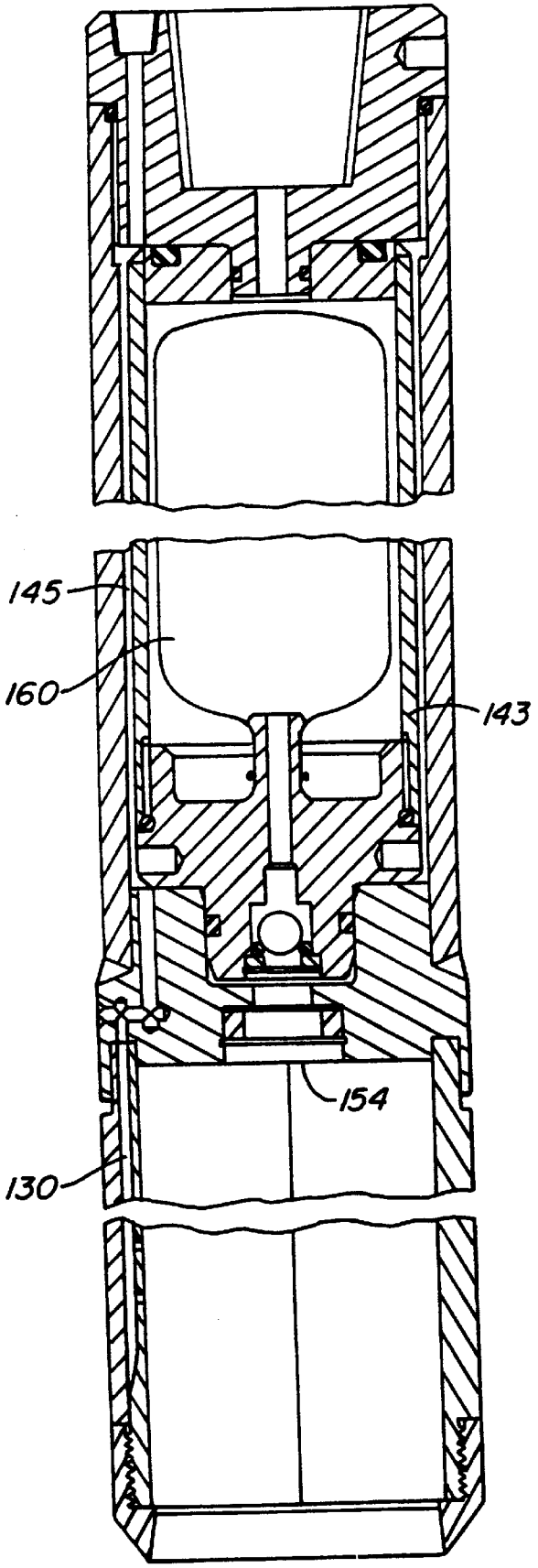
FIG. 8 is a cross-sectional view of the sampling device of FIG. 7 with the fluid entrances penetrating the interior surface of the barrel.

The sampling device preferably includes a plurality of fluid entrances 6 which penetrate the exterior surface 8 of the barrel 4. The fluid entrances 6 have a diameter of about 0.0062 inches and are configured in two rows of six fluid entrances circumferentially spaced around the barrel 4. The fluid entrances 6 are preferably positioned at the downhole end 16 but may be positioned anywhere along the barrel. The fluid entrance 6 may take many forms and shapes. For example, the fluid entrance may be a single slot circumscribing a substantial portion of the circumference, a large number of perforations, vertically disposed slots, or any combination thereof. The fluid entrance 6 preferably penetrates only the exterior surface 8 so that the soil sample within the hollow interior 12 is not chemically biased during collection of the fluid sample. The fluid entrance may, however, also penetrate the interior surface of the barrel (FIG. 8).

The fluid entrance 6 is fluidly coupled to an annular channel 32 formed between the drive shoe 14 and the sample tube 28. The annular channel 32 includes an-enlarged filter cavity 34 which houses a filter 36. The filter cavity 34 has a generally larger cross-sectional flow area than the annular channel 32 to minimize flow resistance at the filter.

Figure 3:
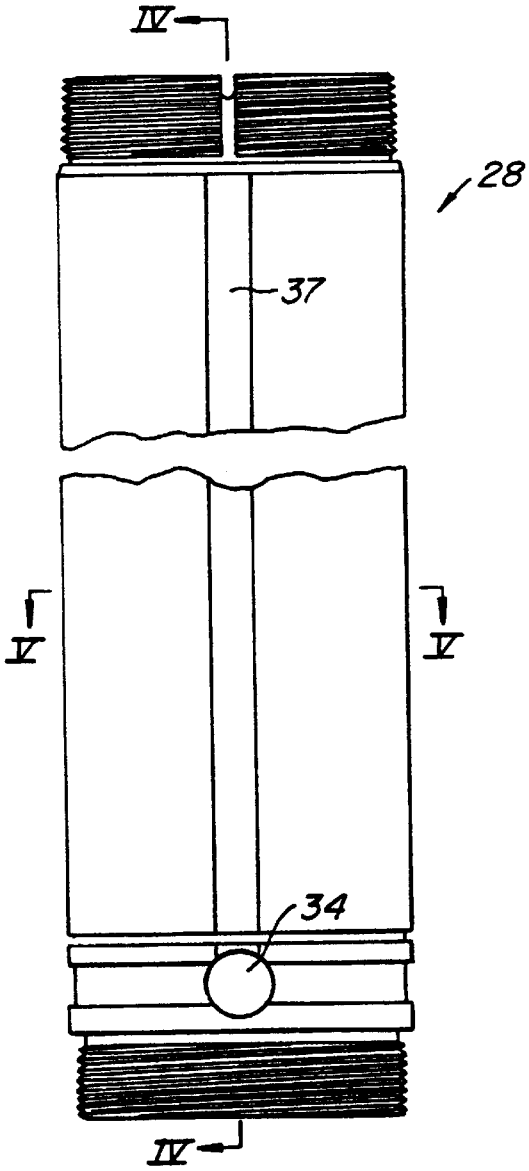
FIG. 3 is a side view of a sample tube.
Figure 4:
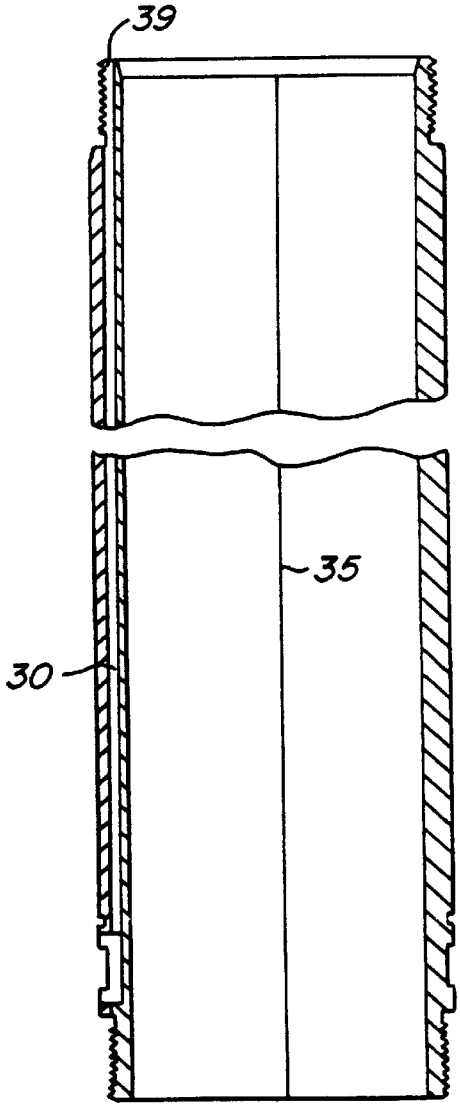
FIG. 4 is a cross-sectional view of the sample tube of FIG. 3 along line IV—IV.

The annular channel 32 is fluidly coupled to a longitudinal channel 30 at the filter cavity 34. The longitudinal channel 30 terminates at an outlet port 39 (FIGS. 2 and 3). The preferred embodiment includes a single channel 30, however, a number of channels may also be used. The channel 30 is formed by cutting a longitudinally T-shaped section into the barrel (FIG. 5). An outer piece 37 is then seal welded into the upper part of the T-shaped section thereby forming the channel 30 between the outer piece 37 and the sample tube 28. A stainless steel tube (not shown) may be brazed into the longitudinal channel 30 to facilitate cleaning and resist corrosion.

The annular channel 32, filter cavity 34, and channel 30 together define the fluid path 38 which is depicted by broken lines 41 in FIG. 1. The fluid path 38 terminates at the outlet port 39 of the barrel 4 (FIG. 2). The fluid path 38 may take many forms so long as it fluidly couples the fluid entrance 6 and the outlet port 39.

The valve assembly 40 is rigidly attached to an upper end of the sample tube 28 by a threaded connection or slip coupling. The valve assembly 40 includes a fluid sample path 42 coupled to the outlet port 39 of the sample tube (FIG. 2). The fluid sample path 42 terminates at an outlet connection 47. The outlet connection may be coupled to a vacuum pump (not shown) for extracting a soil gas sample. The outer body 43 of the valve assembly 40 also includes a threaded rod connection 44 (FIG. 2) for receiving a rod used to drive the sampling device 2 into the subsurface.

The valve assembly 40 houses a displaced air line 50 having an entrance port 52 and an exit port 54. The entrance port 52 opens into the hollow interior 12. A check valve 56, preferably a ball valve, is positioned along the displaced air line 50 between the entrance and exit ports. When the soil sample enters the hollow interior the air displaced by the soil sample is exhausted through the displaced air line 50. The entrance and exit ports 54 also include screens 58 which prevent particulate matter from entering the displaced air line 50. The screens 58 are preferably stainless steel mesh cloth.

A flow preventing mechanism prevents flow into the fluid entrance 6 before the barrel 4 is driven into the subsurface. The flow preventing mechanism ensures that cross-contamination of the fluid sample does not occur. A preferred flow preventing mechanism is an elastic band 59 sized to fit around the exterior surface of the barrel and positioned to cover the fluid entrance 6 (FIG. 1). As the barrel is driven into the subsurface, frictional engagement between the elastic band 59 and the subsurface displaces the elastic band toward the uphole end 17 thereby exposing the fluid entrance 6. The flow preventing mechanism may take many forms such as a flow prevention valve along the fluid path 38. A further flow preventing mechanism is described below in connection with FIGS. 9–13.

Figure 7:
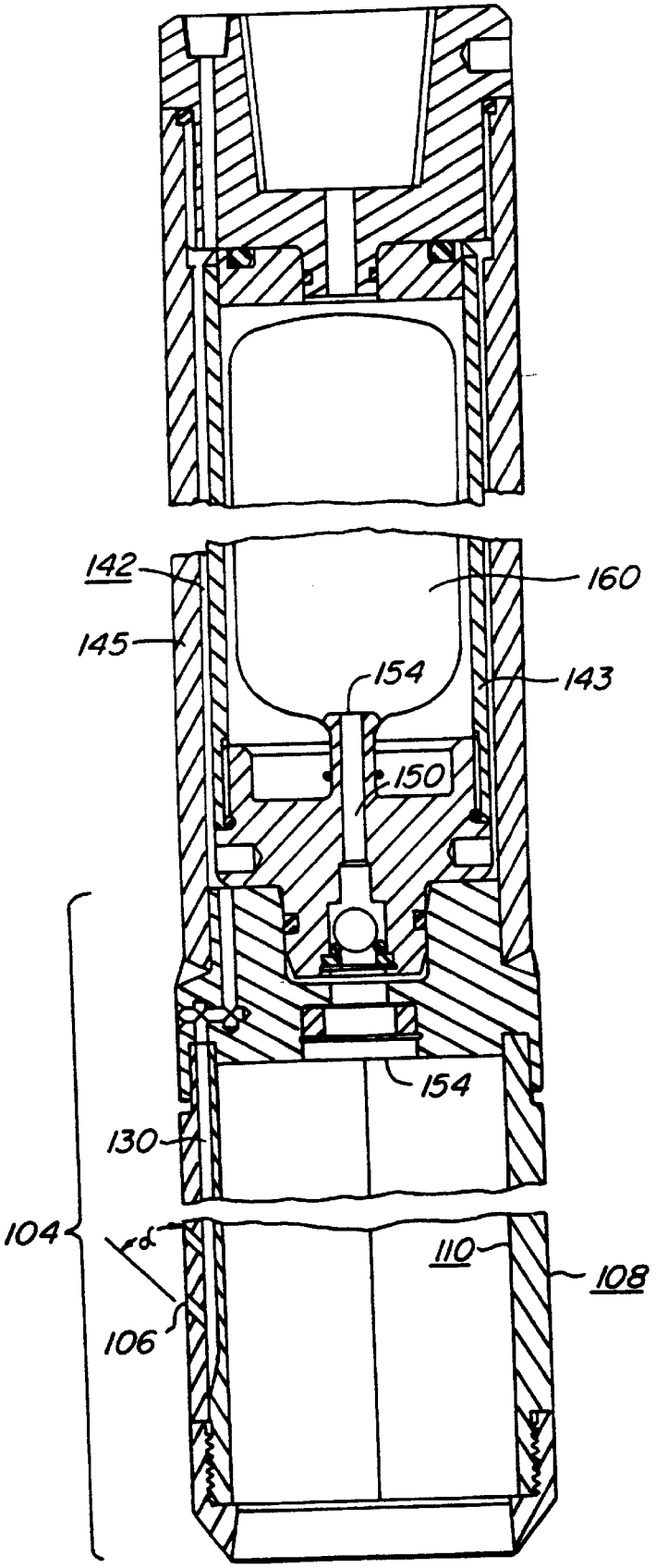
FIG. 7 is a cross-sectional view of a second embodiment of the soil and fluid sampling device.

A second embodiment of the invention is shown in FIG. 7. A sampling device 102 includes a plurality of fluid entrances 106 extending along the length of a longitudinal channel 130 and spaced at one inch intervals. The fluid entrance 106 has a diameter of 0.0062 inches and are at an angle δ of about 45° with respect to the exterior surface 108. The fluid entrance 106 may, of course, take any shape, size and angular orientation.

The longitudinal channel 130 is fluidly coupled to an annular path 142 defined between an outer wall 145 and an inner body 143. The inner body 143 houses a gas bladder 160 which is fluidly coupled to an exit port 154 of a displaced air line 150. The gas bladder stores the air which is displaced in the hollow interior by the soil sample. The gas bladder 160 is preferably evacuated prior to use. FIG. 8 illustrates shows the fluid entrance 106 for the sampling device 102 penetrating an interior surface 110 of the barrel 104. It is understood that any of the other embodiments disclosed herein may also optionally include a fluid entrance penetrating the interior surface.

A third embodiment of the invention is shown in FIGS. 9–13. A sampling device 202 includes a barrel 204 having a sample tube 228, a drive shoe 214 and an inner ring 262. Although the barrel is preferably formed in three parts it may also be formed in any number of parts. The sample tube 228 has first and second sections 231, 233 held together at a downhole end by the drive shoe 214 and inner ring 262 and at an uphole end by a valve assembly 240. A fluid entrance 206 penetrates the inner ring 262 and is used for collecting the fluid sample. Preferably a number of fluid entrances are provided circumferentially spaced around the barrel. As stated in the description of sampling device 2, the fluid entrance may take many forms but is preferably a circular hole having a diameter of about 0.06 inches.

Figure 9:
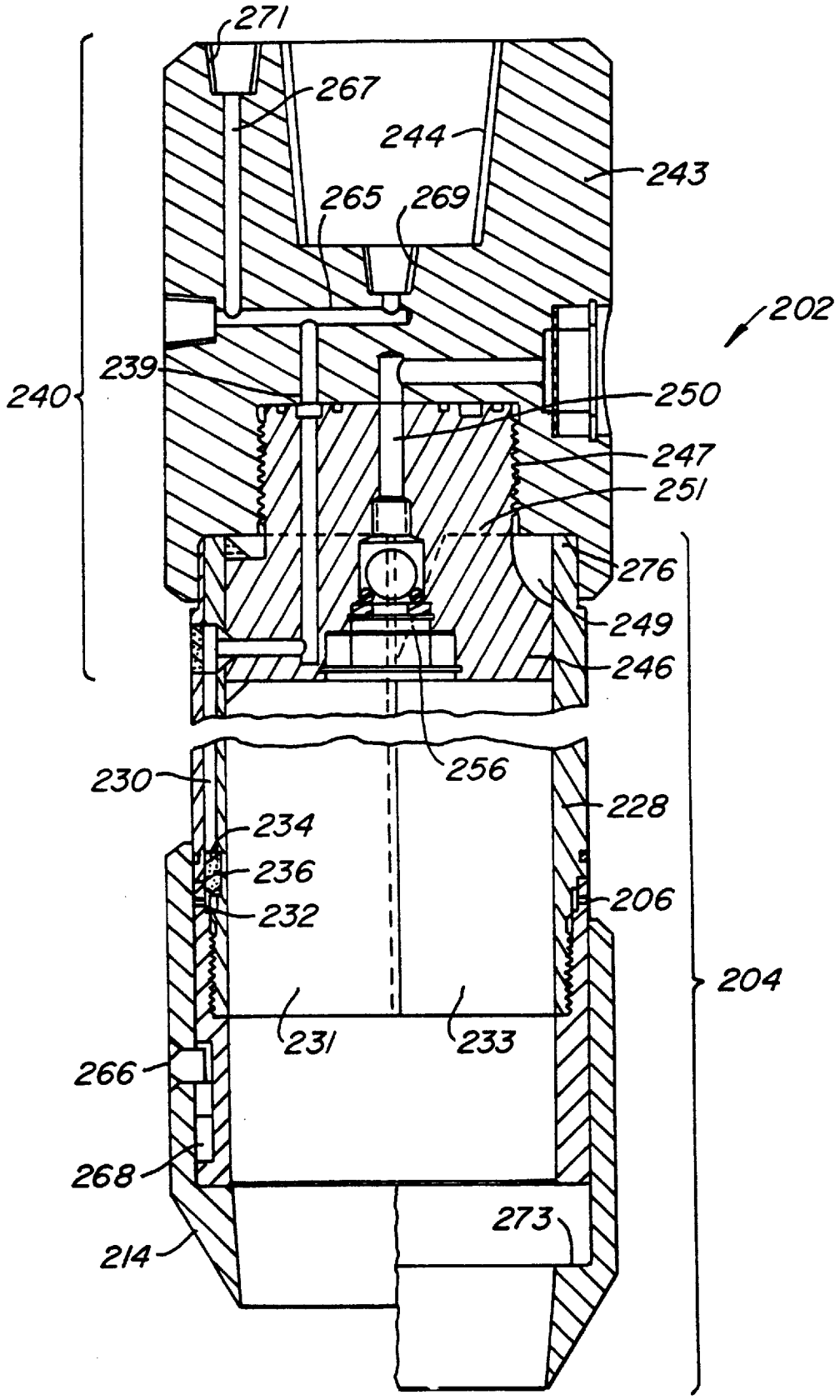
FIG. 9 is a cross-sectional view of a third embodiment of the soil and fluid sampling device with the drive shoe depicted in a first, retracted position, and a second, extended position.
Figure 10:
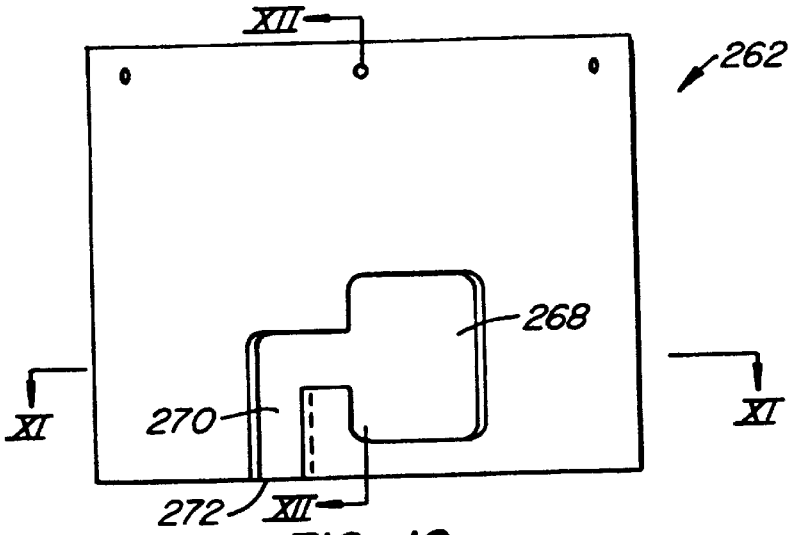
FIG. 10 is a side view of an inner ring.
Figure 11:
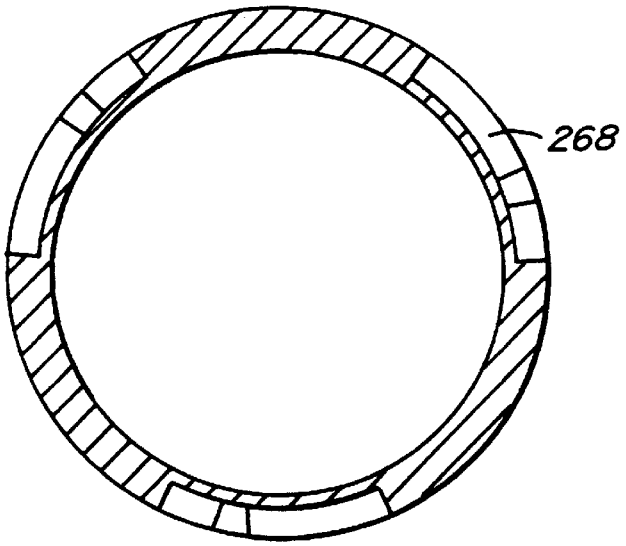
FIG. 11 is a cross-sectional view of the inner ring of FIG. 10 along line XI—XI.
Figure 12:
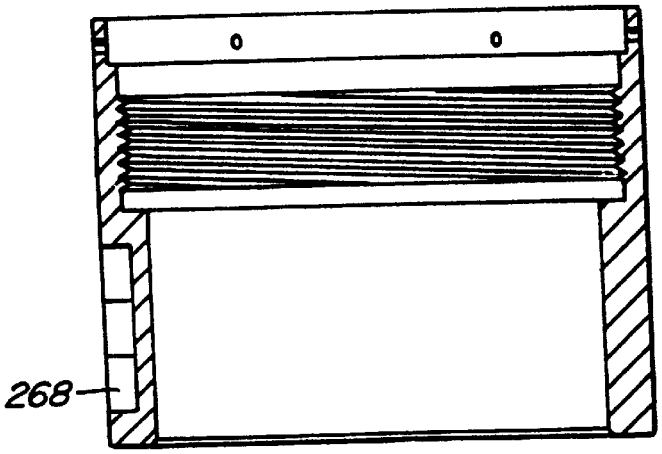
FIG. 12 is a cross-sectional view of the inner ring of FIG. 7 along line XII—XII.
Figure 13:
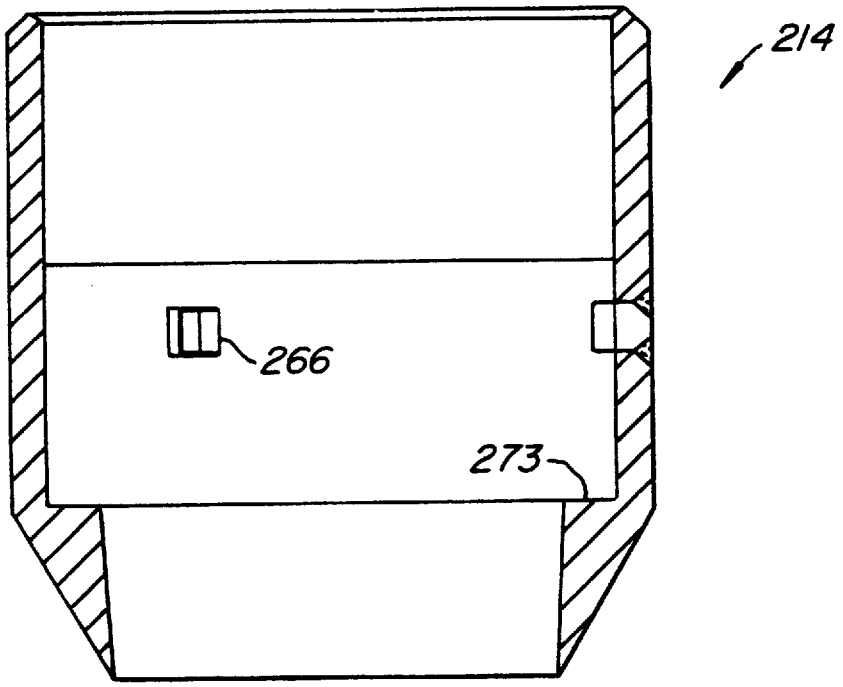
FIG. 13 is a cross-sectional view of the drive shoe for the third embodiment of the soil and fluid sampling device.

The drive shoe 214 is movably coupled to the inner ring 262 between a first position, in which the fluid entrance is covered, and a second position, in which the fluid entrance is exposed. FIG. 9 depicts the drive shoe 214 in both the first and second positions. The left hand side shows the drive shoe 214 in the first position while the right hand side shows the drive shoe 214 in the second position. As discussed below, the sampling device is lowered into the borehole and driven into the subsurface with the drive shoe in the first position to prevent cross-contamination of the fluid sample. The drive shoe is held in the first position by the o-ring. For additional assurance that the drive shoe will not move to the second position the elastic band 59 may also be positioned around the barrel covering part of the drive shoe and part of the sample tube.

The drive shoe 214 has pins 266 which engage pockets 268 in the inner ring 262. The pockets 268 include a slot 270 having an opening 272. The pin 266 is aligned with the opening 272 for installing and removing the drive shoe 214. When the drive shoe is in the first position a shoulder 273 of the drive shoe 214 contacts the inner ring 262 so that a longitudinal load on the drive shoe is transferred directly to the inner ring rather than to the pins 266. When the drive shoe 214 moves to the second position the pins 266 engage a bottom edge 270 of the pocket 268.

The sampling device 202 is lowered into the borehole with the drive shoe 214 in the first position. The sampling device 202 is then driven into the formation thereby forcing the soil sample into the hollow interior of the sampling device 202. The sampling device 202 is then pulled toward the uphole end. As the sampling device is pulled toward the uphole end the drive shoe frictionally engages the formation. The upward movement of the sampling device moves the drive shoe to the second position and exposes the fluid entrance 206. The fluid sample is then collected in the manner described below. The drive shoe 214 may be moved from the first position to the second position by many other methods. For example, the drive shoe may engage the inner ring with a screwed fitting whereby rotary motion of the barrel moves the drive shoe. The drive shoe may also be configured to move without requiring longitudinal movement of the sampling device 202. For example, the sampling device may include an uphole actuating mechanism for moving the drive shoe such as a wire, which can be pulled to move the drive shoe, a hydraulic line, or an electro-mechanical actuator.

The movable drive shoe 214 prevents fluid from entering the fluid entrance 206 until the sampling device is driven into the formation. Any other fluid flow preventing mechanism may also be used. For example, a sleeve may be provided which is movable independent of the drive shoe. The fluid flow preventing mechanism may also be a valve movable between the inner and outer surfaces at the fluid entrance 206. The fluid flow preventing mechanism may also be an elastic band (FIG. 1).

The valve assembly 240 includes an outer body 243 and an inner body 246. The inner body 246 is welded to the first section 231 of the sample tube and connected to the outer body at a threaded connection 247. The inner body 246 and first section 231 may also be formed together. The inner body 246 includes a semi-circumferential cut-out 249 which facilitates removal of the soil sample from the sampling device. After a soil sample is collected in the sampling device 202 the drive shoe 214 and inner ring 262 are removed so that the first and second sections 231, 233 of the sample tube are no longer mechanically connected at the downhole end. The downhole end of the second section 233 is then rotated away from the soil sample with an upper edge 276 of the second section rotating into the cut-out 249. The second section 233 is then removed thereby exposing the soil sample. An upper end of the second section is wedge shaped, as depicted by broken line 251, so that the second section 233 can be rotated away from the first section. The valve assembly 240 also preferably includes a displaced air line 250 and a check valve 256 which operate in the same manner as air line 50 and check valve 56 described above.

The fluid entrance 206, which is preferably a plurality of fluid entrances, is positioned to penetrate the inner ring 262 of the barrel 204. An annular channel 232 is formed between the inner ring and the sample tube 232. The annular channel 232 is coupled to a longitudinal channel 230 extending from the downhole end of the sample tube to an outlet port 239. At the downhole end of the longitudinal channel 230 is a filter cavity 234 housing a filter 236. The filter 236 is preferably a fluid permeable membrane made by POREX®. The POREX® filter is preferably made of a porous plastic with an average mean pore size in the range of 10–150 microns with void volumes of 35–50%. The filter cavity 234 is slightly larger in cross-section than the longitudinal channel 230. A stainless steel tube (not shown) may be brazed into the longitudinal channel 230 to facilitate cleaning and resist corrosion.

The annular channel 232 and longitudinal channel 230 together define a fluid path 238. The fluid path 238 may take any form so long as it fluidly couples the fluid entrance 206 and the outlet port 239.

The outer body 243 includes a liquid sample path 265 and a gas sample path 267. The liquid sample path leads to a rod connection 244 which receives a rod used to drive the sampling device into the subsurface. The liquid and gas sample paths terminate at liquid and gas ports 269, 271. The port are adapted to receive a plug which seals the respective sample path.

The method of collecting fluid and soil samples of the present invention is described below in connection with the preferred embodiment of FIGS. 9–13. The method may, of course, be practiced using any device adapted to perform the steps as defined by the claims and is not limited to the specific embodiment described herein.

Figure 15:
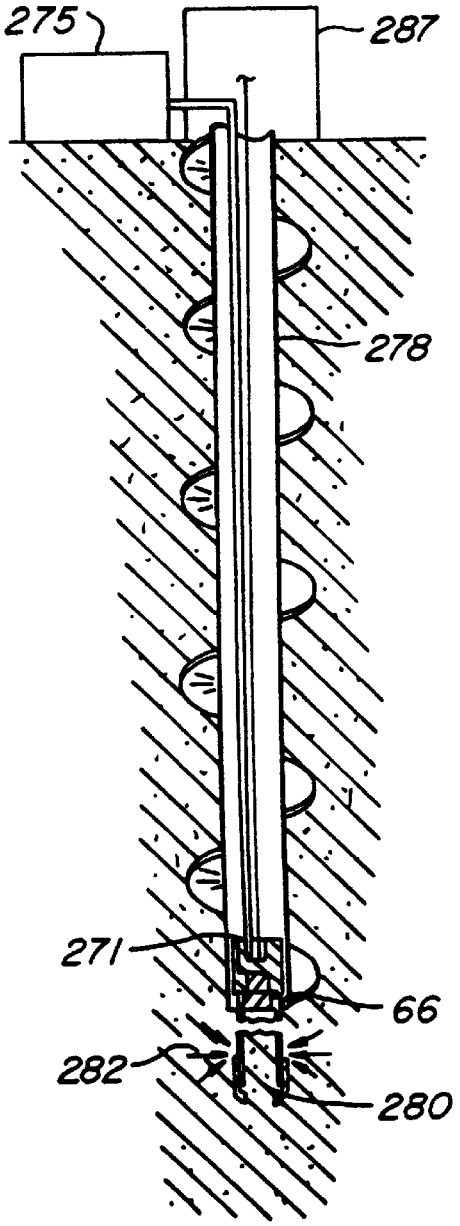
FIG. 15 shows the sampling device of FIGS. 9–13 driven into a subsurface for collecting a soil gas sample.

The sampling device 202 is decontaminated and configured in the desired sampling mode. If a soil gas sample is desired a vacuum pump 275 is coupled to the gas port 271 and a plug is inserted into the liquid port 269 (FIG. 15). The plug prevents prevent flow through the liquid port.

A borehole is drilled into the subsurface with a hollow stem auger 278 or any other drilling method. The hollow stem auger 278 advantageously minimizes cross-contamination in the borehole. If surface samples are desired a borehole is obviously not necessary. After the borehole is drilled to the desired depth the sampling device 202 is lowered into the hollow stem auger 278 to the bottom of the borehole.

The sampling device 202 is then driven into a terminal end 66 of the borehole with the drive shoe 214 in the first position. The sampling device is preferably driven into the subsurface with a wire line driven downhole hammer device 287 but may, of course, be driven into the subsurface by any other method. As the sampling device 202 is driven into the terminal end 66 a soil sample 280 is forced into the hollow interior 12.

After the sampling device 202 has been driven into the terminal end 66 of the borehole the sampling device is pulled toward the uphole end to move the drive shoe to the second position relative to the inner ring. Movement of the drive shoe exposes the fluid entrances 206. The vacuum pump 275 is then turned on to draw a soil gas sample into the fluid entrance 206 and through the fluid path 238. The soil gas flow into the fluid entrances 206 is depicted by arrows 282. After the soil gas sample has been collected the sampling device is recovered to obtain the soil sample.

If a liquid sample is desired the sampling device 202 is preferably configured as follows. A hollow rod 285 is inserted into the rod connection 244 and a plug is inserted into the gas port 271. The sampling device 202 is then driven into the subsurface by any conventional method and preferably by an uphole hammering device 286. The sampling device is pulled back toward the uphole end to move the drive shoe to the second position and expose the fluid entrances 206.

Figure 14:
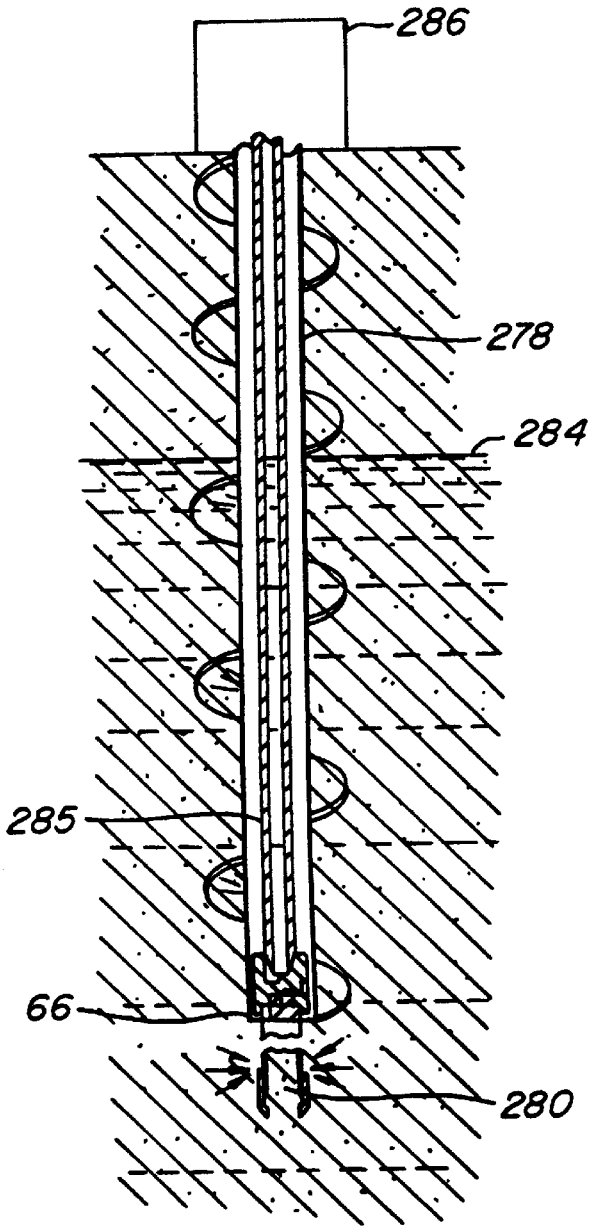
FIG. 14 shows the sampling device of FIGS. 9–13 driven into a subsurface for collecting a liquid sample.

Referring to FIG. 14, the liquid in the subsurface enters the fluid entrance and rises through the sampling device and into the hollow rod 285 under a potentiometric head 284 of the liquid in the formation (FIG. 14). A liquid collection device, such as a bailer, is lowered into the hollow rod 285 to obtain the liquid sample.

By collecting fluid and soil samples simultaneously, minimally disturbed samples are provided. In addition, the operating time required to collect both soil and fluid samples is decreased since only one downhole trip is necessary to collect fluid and soil samples.

Modification and variation can be made to the disclosed embodiments without departing from the subject of the invention as defined by the following claims. For example, the exterior surface may be rectangular or irregularly shaped, the fluid entrance may be positioned at the uphole end rather than the downhole end, and the flow path may be formed by an annular space between two concentric tubes. Furthermore, the scope of the invention as it pertains to environmental sampling is developed only as an example of one particular use for the invention. The method and apparatus of the present invention may, of course, be used to obtain samples for any other purpose such as oil, gas and geothermal exploration.

What is claimed is:

1. A method for collecting a soil sample and a fluid sample from a subsurface comprising the steps of:

providing a sampling device including a barrel having a downhole end, an exterior surface, an interior surface defining a hollow interior, having a circular cross-section and an open end at the downhole end of the hollow interior, the sampling device further comprising a fluid entrance and a fluid path, the fluid entrance penetrating the exterior surface, and the fluid path being fluidly coupled to the fluid entrance;

driving the downhole end of the sampling device into a subsurface so that a soil sample of the subsurface is forced through the open end and into the hollow interior;

collecting a fluid sample from the subsurface through the fluid entrance and the fluid path after the driving step is initiated; and removing the sampling device from the subsurface to recover the soil sample after the collecting step is completed.

2. The method for collecting a soil sample and a fluid sample of claim 1 further comprising the step of:

preventing a fluid flow through the fluid entrance at least until after the driving step has been initiated.

3. The method for collecting a soil sample and a fluid sample of claim 1 wherein:

the fluid path is positioned between the interior and exterior surfaces.

4. The method for collecting a soil sample and a fluid sample of claim 1 wherein:

the preventing step is carried out by providing a drive shoe having an angular cutting edge defining the open end, the drive shoe being movably mounted to the barrel between a first position, in which the drive shoe covers the fluid entrance, and a second position, in which the drive shoe is spaced apart from the fluid entrance.

5. The method for collecting a soil sample and a fluid sample of claim 1 wherein:

the driving step is carried out with a barrel comprising a drive shoe having an angular cutting edge defining the open end.

6. The method for collecting a soil sample and a fluid sample of claim 1 wherein:

the collecting and driving steps are carried out a number of times.

7. The method for collecting a soil sample and a fluid sample of claim 1 wherein:

the collecting step is carried out by drawing the fluid into the fluid entrance using a vacuum pump.

8. The method for collecting a soil sample and a fluid sample of claim 1 wherein:

the collecting step is carried out by permitting the fluid to enter the fluid entrance under a potentiometric head of the fluid in the subsurface.

9. The method for collecting a soil sample and a fluid sample of claim 1 further comprising the step of:

pulling the sampling device toward an uphole end before the collecting and removing steps.

10. An environmental sampling device for collecting a fluid sample and a soil sample from a subsurface, comprising:

a barrel including a downhole end, an exterior surface, an interior surface defining a hollow interior having a circular cross-section, and an open end at the downhole end of the hollow interior;

a fluid entrance penetrating the exterior surface;

a fluid path fluidly coupled to the fluid entrance; and an elastic band sized to fit around the barrel and positioned to cover the fluid entrance.

11. An environmental sampling device for collecting a fluid sample and a soil sample from a subsurface, comprising:

a barrel including a downhole end, and exterior surface, an interior surface defining a hollow interior having a circular cross-section, and an open end at the downhole end of the hollow interior;

a fluid entrance penetrating the exterior surface;

means for selectively covering the fluid entrance, the covering means being movable between a first position covering the fluid entrance and a second position spaced apart from the fluid entrance; and a fluid path fluidly coupled to the fluid entrance;

the barrel having a drive shoe, the drive shoe being rigidly attached to the downhole end of the barrel and having an angular cutting edge defining the open end.

12. The environmental sampling device of claim 11 wherein:

the drive shoe defines a portion of the exterior surface of the barrel; and the fluid entrance penetrates the portion of the exterior surface at the drive shoe.

13. An environmental sampling device for collecting a fluid sample and a soil sample from a subsurface, comprising:

a barrel including a downhole end, and exterior surface, an interior surface defining a hollow interior having a circular cross-section, and an open end at the downhole end of the hollow interior;

a fluid entrance penetrating the exterior surface;

means for selectively covering the fluid entrance, the covering means being movable between a first position covering the fluid entrance and a second position spaced apart from the fluid entrance;

a fluid path fluidly coupled to the fluid entrance; and a valve assembly rigidly attached to the barrel at an uphole end, the valve assembly including a displaced air line having an exhaust port and an entrance port, the entrance port being fluidly coupled to the hollow interior.

14. The environmental sampling device of claim 13 further comprising:

a check valve positioned along the displaced air line between the entrance port and the exhaust port, the check valve permitting flow from the entrance port to the exhaust port.

15. The environmental sampling device of claim 14 further comprising:

a gas bladder fluidly coupled to the exhaust port.

16. An environmental sampling device for collecting a fluid sample and a soil sample from a subsurface, comprising:

a barrel including a downhole end, and exterior surface, an interior surface defining a hollow interior having a circular cross-section, and an open end at the downhole end of the hollow interior;

a fluid entrance penetrating the exterior surface;

means for selectively covering the fluid entrance, the covering means being movable between a first position covering the fluid entrance and a second position spaced apart from the fluid entrance; a fluid path fluidly coupled to the fluid entrance;

the barrel including a drive shoe, the drive shoe being positioned at a downhole end of the barrel and having an angular cutting edge defining the open end of the barrel, the drive shoe being movably mounted to the sample tube between a first position in which the drive shoe covers the fluid entrance, and a second position, in which the drive shoe is spaced apart from the fluid entrance.

17. An environmental sampling device for collecting a fluid sample and a soil sample from a subsurface, comprising:

a cylindrical sample tube comprising first and second sections connected together along longitudinal split lines, the sample tube having an exterior surface, an interior surface defining a hollow interior, and an open end at the downhole end of the hollow interior, the hollow interior including a circular cross–sectional shape having a diameter in a range of about one inch to six inches;

a fluid entrance penetrating the interior surface;

a fluid path fluidly coupled to the fluid entrance and positioned between the interior and exterior surfaces; and means for selectively preventing a fluid flow through the fluid entrance.

* * * * *